United States Patent [19]

Schoeps

[11] 3,981,647

[45] Sept. 21, 1976

[54] PNEUMATIC VANE MOTOR

[75] Inventor: Knut Christian Schoeps, Tyreso, Sweden

[73] Assignee: Atlas Copco Aktiebolag, Nacka, Sweden

[22] Filed: Feb. 24, 1975

[21] Appl. No.: 552,331

[30] Foreign Application Priority Data

Mar. 8, 1974 Sweden ..... 7403166

[52] U.S. Cl. ..... 418/259; 418/270; 418/241

[51] Int. Cl.[2] ..... F01C 21/00

[58] Field of Search ..... 418/268, 270, 259, 266, 418/267, 241

[56] References Cited

UNITED STATES PATENTS

| | | | |
|---|---|---|---|
| 3,159,336 | 12/1964 | Paschke | 418/122 |
| 3,767,335 | 10/1973 | Kramer et al. | 418/259 |

FOREIGN PATENTS OR APPLICATIONS

| | | | |
|---|---|---|---|
| 575,753 | 5/1959 | Canada | 418/267 |
| 842,451 | 6/1952 | Germany | 418/138 |
| 1,251,579 | 10/1967 | Germany | 418/122 |
| 1,871,805 | 2/1963 | Germany | 418/122 |

*Primary Examiner*—C. J. Husar
*Attorney, Agent, or Firm*—Flynn & Frishauf

[57] ABSTRACT

A pneumatic vane motor comprising a cylinder and a vane carrying rotor. The vanes are reciprocably guided in radial slots in the rotor, which slots have a width exceeding the thickness of the vanes. For preventing the vanes from seating flatly on the slot walls they are provided with projection protruding from their both faces at a distance from their inner edges. Thereby, the projections are protected from wear as the vanes, during load transmission to the rotor, reciprocate in the slots.

10 Claims, 7 Drawing Figures

FIG. 4
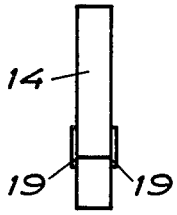
FIG. 3
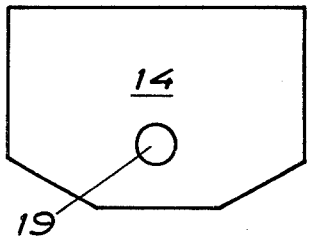
FIG. 6
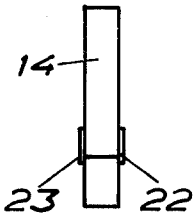
FIG. 5
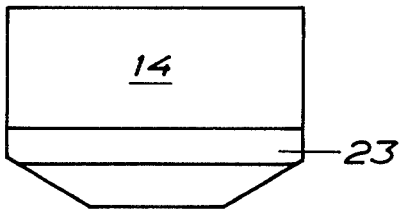
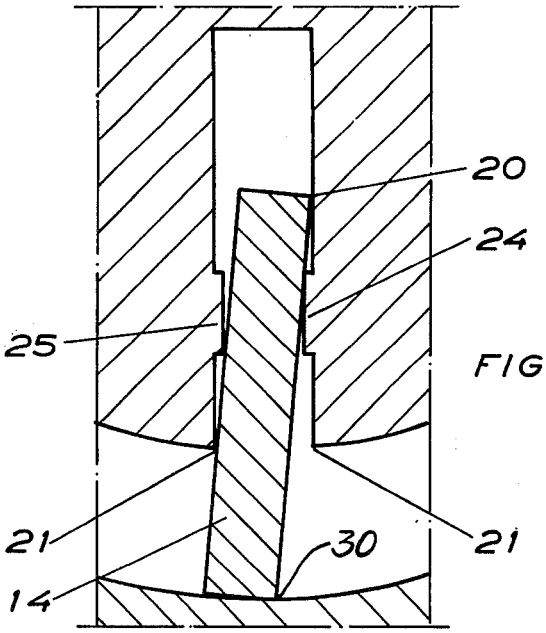
FIG. 7

PNEUMATIC VANE MOTOR

BACKGROUND OF THE INVENTION

This invention relates to pneumatic vane motors comprising a cylinder housing and a rotor provided with axially extending, radial slots in which vanes of less width than the slots are reciprocably guided.

In order to prevent the vanes from getting stuck in the slots because of a tight face-to-face engagement it has been previously suggested to provide the vanes with laterally protruding distance (or spacing) means or heels located at the inner edges of the vanes. There is, however, a serious disadvantage involved in such an arrangement, because, when the vanes are loaded by motive pressure air in the cylinder for propelling the rotor, they take support against one of the slot walls with their inner edges. The result is that the distance (or spacing) heels are exposed to a considerable wear as the motor is in operation and as the vanes reciprocate in the rotor slots. After some time of running, the distance (or spacing) heels are worn out and the vanes may be stuck in the slots due to adherence.

SUMMARY OF THE INVENTION

According to the invention this problem is solved in that the vanes are provided with distance means located at such a distance from the inner edges of the vanes that they are not exposed to any wear.

BRIEF DESCRIPTION OF THE DRAWINGS

Embodiments of the invention are hereinafter described in detail with reference to the drawings, wherein:

FIG. 3 shows a side elevation of a vane used in the motor in FIG. 1.

FIG. 4 is an end view of the vane shown in FIG. 3.

FIGS. 5 and 6 correspond to FIGS. 3 and 4 but show an alternative vane design.

FIG. 7 corresponds to FIG. 2 but shows an alternative design.

DESCRIPTION OF PREFERRED EMBODIMENT

Figure 1:
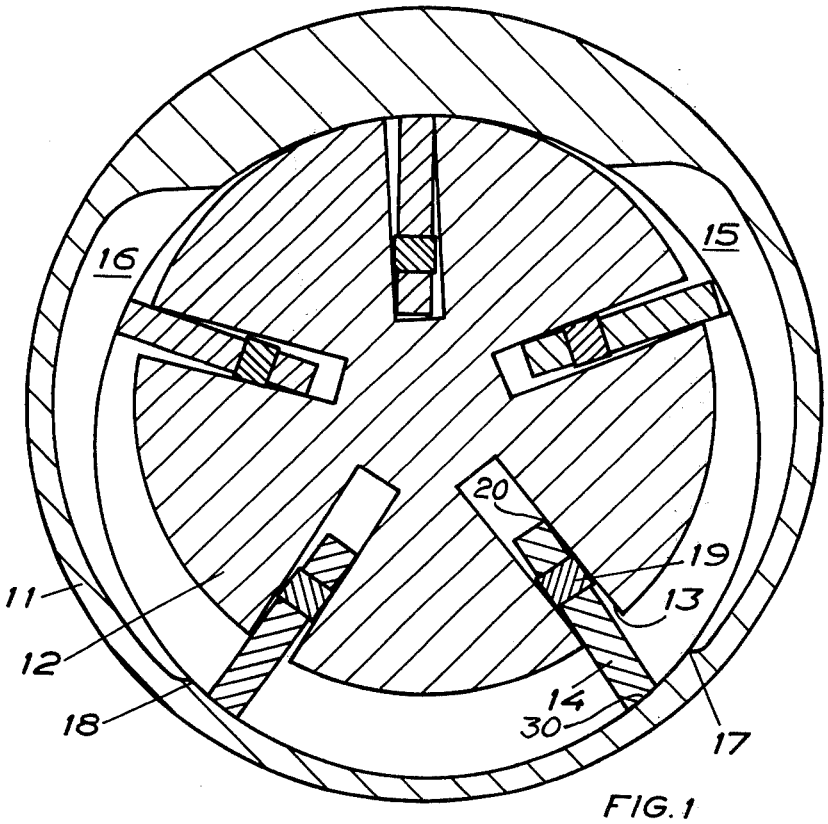
FIG. 1 is a cross section through a motor according to the invention.

The vane motor shown in FIG. 1 comprises a cylinder 11 and a rotor 12 journalled eccentrically therein for rotation in the direction indicated by the arrow. The rotor 12 is provided with five axially directed radial slots 13 in which vanes 14 are carried. The vanes 14 are slidably guided in the slots 13 for reciprocative movement during rotation of the rotor 12.

The cylinder 11 comprises inlet and outlet openings, 15 and 16 respectively, for motive pressure air and non-illustrated air passages in its end walls through which pressure air is suppliable to the bottom regions of the rotor slots 13 for biasing the vanes 14 outwardly against the cylinder. The cylinder 11 also comprises a portion that is concentric relative to the rotor 12, which portion extends from the closing edge 17 of the air inlet opening 15 to the opening edge 18 of the air outlet opening 16. This cylinder configuration is advantageous in that the vanes are not caused to move radially in the slots 13 as they pass therethrough, and as the vanes are loaded by motive air during passing this cylinder portion they are by this arrangement protected from heavy frictional wear in the slots.

Figure 2:
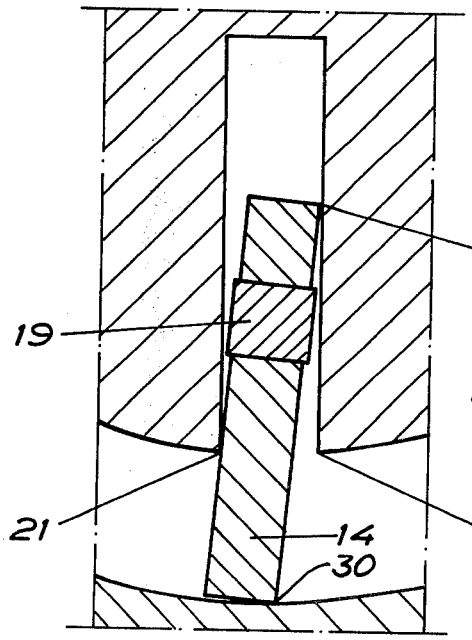
FIG. 2 shows, in larger scale, a part of the motor in FIG. 1.

As more clearly seen in FIG. 2, each of the vanes 14 comprises two opposite flat faces and an inner edge 20 and an outer edge 30. Due to the above mentioned biasing load applied to each vane the outer edge 30 is continuously kept in contact with the cylinder 11, thereby making the vane reciprocate between a retracted position and an extended position relative to the rotor slot 13 as the rotor 12 rotates.

As being apparent from the drawings the slot 13 has a larger width than the vane 14 resulting in the fact that the vane is brought into a tilted position when loaded by motive air in the cylinder. In this position the vane transfers the motive air load to the rotor in two linear and radially spaced contact zones which are defined by the inner edge 20 of the vane 14 and the outer edge 21 of the slot 13. The radial distance between these zones depends on the actual protrution of the vane, so that when the vane is in its fully extended position, e.g. when it passes the concentric cylinder part between the inlet and outlet openings 15,16, the contact zones are in their closest position. As the vane is fully retracted in the slot this distance is substantially equal to the vane height.

In order to prevent the vanes from getting stuck in the slots because of adherence to the slot walls, they are provided with projections or heels on their both faces. According to the embodiment shown in FIGS. 1–4 such a projection is constituted by a plug 19 extending through a transverse hole in the vane. The length of the plug 19 exceeds the thickness of the vane, and the plug is fixed relative to the vane so that its both ends form projections protruding from both of the vane faces. The plug 19 may be secured to the vane with press fit or by means of a glue.

For ensuring that the projections are not subjected to any considerable load they are located at such a distance from the vane inner edge 20 that they are substantially right between the two contact zones as the vane is in its fully extended position. See FIG. 2.

Instead of using a plug for forming the projections, the vanes may be provided with a rib-like heel 23 as shown in FIGS. 5 and 6. This heel 23 may be formed in one piece with the vane or attached thereto by means of a glue.

The above described distance (or spacing) means, plug-like or rib-like, may be made from plastic or from a metallic bearing material.

SECOND EMBODIMENT — FIG. 7

In FIG. 7 there is shown an alternative distance means for keeping a vane out of face-to-face engagement with the slot walls. According to this embodiment of the invention the vane has completely flat faces and the distance (or spacing) means is constituted by heels 24 projecting from the slot walls. These heels 24 are located at a distance from the outer edge 21 of the rotor slot so that, when the vane 14 is in its fully extended position, they are substantially right between the two contact zones, similar to the first embodiment described above.

While two specific embodiments of the invention are shown and described in detail, this invention is not limited to these embodiments but can be freely varied in accordance with the concepts and teachings of this invention.

I claim:

1. In a pneumatic vane motor comprising:

a cylinder provided with inlet and outlet openings for motive pressure air; a rotor eccentrically located within and rotatably journalled relative to said housing, said rotor comprising radial slots therein extending throughout the length thereof; and a plurality of vanes, each vane having an outer edge adapted to contact a wall of the cylinder, an inner edge adapted to be within a slot of said rotor and opposite faces defined between said outer and inner edges, respective vanes being disposed within said slots and arranged to be urged outwardly to urge their outer edges into contact with the cylinder wall, each of said vanes having a thickness defined between said opposite faces which is less than the width of the slot within which it is disposed;

the improvement wherein each vane is provided with projections protruding from both of its opposite sides and spaced a substantial distance from its inner edge for preventing the vane from seating flatly on the slot walls and for substantially preventing the projections from being exposed to contact pressure between the vanes and the slot walls.

2. A pneumatic vane motor according to claim 1 wherein said projections on said vanes extend in the lengthwise direction of said rotor.

3. In a pneumatic vane motor comprising:

a cylinder having inlet and outlet openings for motive pressure air; a rotor eccentrically journalled relative to, and within said housing, said rotor having radially and longitudinally extending slots therein; and a number of vanes carried in said slots, each of which, through radial reciprocation in one of said slots, is arranged to maintain contact with the cylinder during rotation of said rotor, each of said vanes comprising an outer edge for cooperation with the cylinder, an inner edge and two opposite flat faces, and each vane being of such a less width than its respective slot that it gets tilted relative to the slot when loaded with motive pressure air;

the improvement comprising projections protruding from the opposite flat vane faces and spaced a substantial distance from said inner edge such that they prevent the flat vane faces from getting into face-to-face engagement with the slot walls without the projections being subjected to any load as the vane is tilted.

4. A pneumatic vane motor according to claim 3 wherein said projections on said vanes extend in the longitudinal direction of said rotor slots.

5. In a pneumatic vane motor comprising:

a cylinder having inlet and outlet openings for motive air; a rotor having radially and longitudinally extending slots, each slot being defined by two opposite flat side walls; and a plurality of vanes carried by said rotor within said slots for reciprocative movement of said vanes therein between a retracted position and an extended position during rotation of the rotor, each vane being defined by an inner and an outer edge and two opposite faces; each of said slots being of such a width between its two opposite flat side walls that the vane occupies a tilted position relative thereto when exposed to motive air, thereby taking support with its inner edge against one of the slot walls with one of its faces against an outer edge of the opposite slot wall;

the improvement comprising spacing means protruding in opposite directions from said vane faces and spaced a substantial distance from said inner edge of the vane such that the spacing means does not transfer any load from the vane to the slot walls when the vane is tilted and that the spacing means remains within the slot even when the vane is in its said extended position.

6. A pneumatic vane motor according to claim 5 wherein the spacing means on said vane faces extends in the longitudinal direction of the rotor slots.

7. In a pneumatic vane motor comprising:

a cylinder provided with inlet and outlet openings for motive pressure air; a rotor eccentrically journalled relative to said housing and provided with radially and longitudinally extending slots, each of said slots being defined by a bottom and opposite side walls; and a vane carried by said rotor in each of said slots, said vane comprising two flat faces, an inner edge and an outer edge, and being of such a less width than its respective slot that it is tilted relative thereto when exposed to motive air, thereby taking support with its inner edge against one of the slot walls and with one of its faces against an outer edge of the opposite slot wall;

the improvement comprising spacing means projecting from both of the walls of said each slot for preventing the vane from seating flatly against the slot walls, said spacing means being located at such a distance from the slot bottom that it is not exposed to any support force from the vane when the vane is tilted.

8. A pneumatic vane motor according to claim 7 wherein said spacing means projecting from the walls of each slot extend in the longitudinal direction of said slots.

9. In a pneumatic sliding vane motor comprising:

a cylinder having inlet and outlet openings for motive air; a rotor journalled within the cylinder and having a number of radial slots therein; and a number of vanes carried in said radial slots to be exposed to a motive air load in the cylinder, each of said vanes being arranged to transfer the motive air load to the rotor in two linear, radially spaced contact zones in each slot;

the improvement comprising spacing means located radially between said contact zones for preventing the vanes from seating flatly against the slot walls and said spacing means being further located so that it does not take part in the vane load transference to the rotor.

10. A pneumatic sliding vane motor according to claim 9 wherein said spacing means extends in the lengthwise direction, and substantially parallel with the journal axis of said rotor.

* * * * *